United States Patent [19]

Westermeyer

[11] Patent Number: 4,608,546

[45] Date of Patent: Aug. 26, 1986

[54] AUTOMATIC SWITCH WITH IMPACT-ARMATURE TRIPPING DEVICE

[75] Inventor: Joseph Westermeyer, Nuremberg, Fed. Rep. of Germany

[73] Assignee: Sursum Elektrizitatsgesellschaft Leyhausen GmbH & Co., Nuremberg, Fed. Rep. of Germany

[21] Appl. No.: 664,009

[22] Filed: Oct. 23, 1984

[30] Foreign Application Priority Data

Oct. 29, 1983 [DE] Fed. Rep. of Germany ..... 3339400

[51] Int. Cl.[4] ..... H01H 83/00; H01H 75/00

[52] U.S. Cl. ..... 335/20; 335/14; 335/175

[58] Field of Search ..... 335/20, 14, 175, 6

[56] References Cited

U.S. PATENT DOCUMENTS 4,206,430 6/1980 Rusch et al. ..... 335/20

4,223,288 9/1980 Stiner ..... 335/20

*Primary Examiner*—Harold Broome

*Attorney, Agent, or Firm*—Holman & Stern

[57] ABSTRACT

An arc-quenching automatic switch which includes an impact-armature tripping device, comprised of an armature core and an armature rod, a set of deionization plates, a thermostatic element, and a secondary circuit-breaking device which switches off said automatic switch in response to an external event. This event can be remotely sensed and registered by a current or voltage signal corresponding to said event whereby said event may be pre-arranged to trigger the open-circuit. This additional circuit-breaking device is comprised of a operating device for a coupling rod which projects into the armature core of the impact-armature tripping device.

11 Claims, 2 Drawing Figures

AUTOMATIC SWITCH WITH IMPACT-ARMATURE TRIPPING DEVICE

BACKGROUND OF THE INVENTION

1. Field of the Invention

The invention relates to an automatic switch which is comprised of a narrow housing having sidewalls, wherein to produce the closed-circuit position a movable contact element is moveable into contact with a fixed contact element by a switch mechanism and can be held in the closed position under force and wherein an impact-armature tripping means, or solenoid, is provided to release this closing force and open the switch contacts. This impact-armature tripping means is comprised of an impact armature in a coil, a forwardly projecting rod, and a back side disposed opposite to said projecting rod and near and parallel to a region of the sidewall.

2. Description of the Prior Art

In a known automatic switch of this type (Ger. AS No. 19 04 731) the sidewall region which is parallel to the back side of the impact-armature tripping means further comprises an external connecting terminal, and the switch contact is broken only in response to the actuation of a hand lever and to the current passing through said switch. There are instances in which it is desirable to break the contacts in response to other events. For example, if the switch housing is under a certain voltage associated with a current flowing through the automatic switch, then that switch should open when the switch housing is grounded (e.g., by contact with a person) thereby avoiding a discharge.

BRIEF SUMMARY OF THE INVENTION

Accordingly, it is an object of the invention to devise an automatic switch of the type described supra, which switch can be opened automatically in a mechanically simple fashion in response to an external event which can be registered by a current or voltage signal corresponding to said external event; additionally, the switch could be opened through joint manual, thermostatic, and primary-current-surge means.

Therefore, this invention consists of an automatic switch characterized in that the exterior of the side wall region parallel to the back side of the impact-armature tripping means is free of superfluous component parts thereby permitting the integration of an additional circuit-breaking device. Furthermore, said additional circuit-breaking device includes an operating device for a coupling rod which projects beyond said additional circuit-breaking device and through the sidewall of the main switch housing to the back side of the impact-armature tripping means (solenoid). A hollow armature core disposed within the coils of said impact-armature tripping means has an axial borehole which accommodates the end part of the coupling rod so that said coupling rod is slidable back and forth therein. Thus, this coupling rod engages another forwardly projecting plastic (or nonferromagnetic material) armature rod, also disposed within the coils of the solenoid, which mechanically decouples the switch contacts through appropriate pivotal lever means.

The signal voltage or current from the sensed external event is converted in the additional circuit-breaking device, which may be a minimum-operating-current switch of known type, whereby an output signal is generated which actuates the movement mechanism which slides the coupling rod into the armature core thereby initiating contact-breaking. The structure of the additional circuit-breaking device is itself well known; said device amplifies a signal (e.g., a low-current detection signal) so as to generate an output signal which causes the displacement of a core by means of a coil, which core slides the coupling rod above-described. The invention combines this additional movement device with the automatic switch of the type described above (i.e., with integrated manual, thermostatic, and primary-current-reacting means) wherein the back side of the impact-armature tripping means already approaches or extends to the sidewall. As a rule, the automatic switch employed is also comprised of a bimetallic tripping means. Since the additional circuit-breaking device acts directly on the armature core and thereby on the independent armature rod, it does not need to act on the spring of said armature core.

The coupling rod is distinct from the aforesaid forwardly projecting armature rod thereby facilitating easier assembly than if these elements were unitary. If the diameter of the axial borehole in the armature core is less than one-half the diameter of said armature, the effect of the void on the magnetic properties of the armature core is negligible. If the coupling rod is comprised of a nonferromagnetic material, e.g., plastic, the possibility of the coupling rod jamming in the armature core is avoided. If the end of the coupling rod which engages the armature rod bears a disk which extends behind the armature core and engages said armature core, while being countersunk in the armature core then the coupling rod and the armature core can both engage the independent armature rod, and the presence of the disk does not shorten the distance between the armature rod and the armature core.

A preferred embodiment of the invention is illustrated in the drawings.

DETAILED DESCRIPTION

Figure 1:
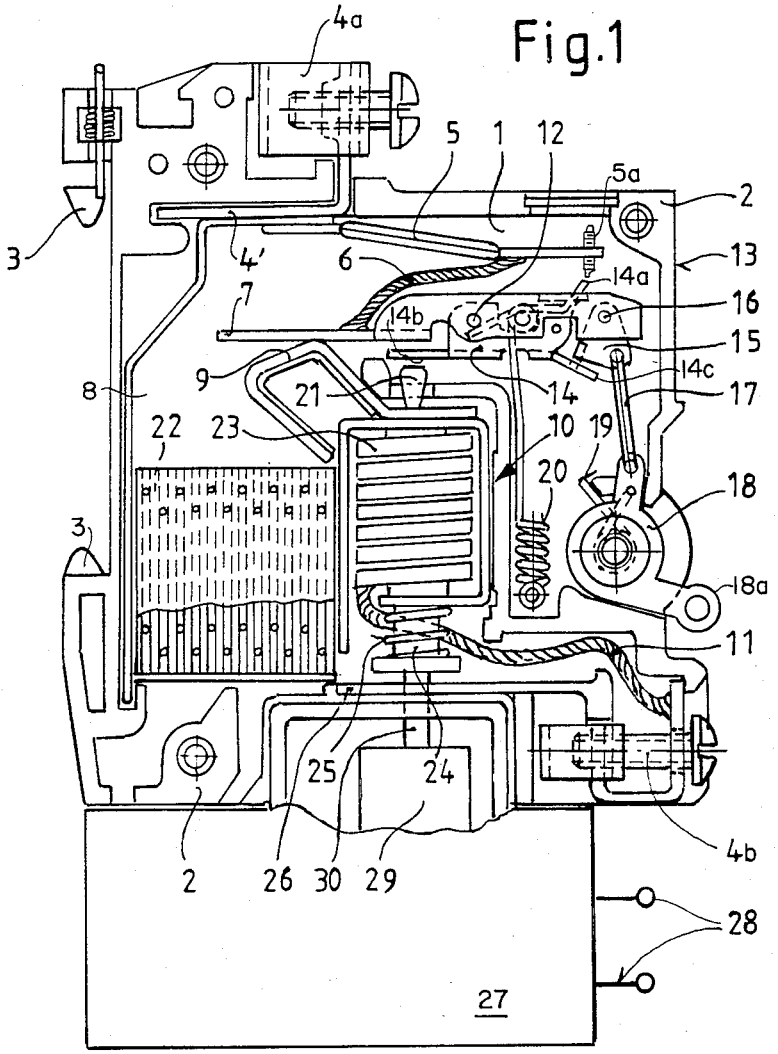
FIG. 1 is a side cutaway view of the automatic switch with an integrated secondary circuit-breaking device.

The automatic switch illustrated in FIG. 1 is comprised of several parts, including a narrow housing, or box, 1 and a cover (not shown) which is placed on said housing. Three eyelets 2 are located on the side walls of the box 1 and provided with boreholes which correspond to those holes of the cover through which rivets might extend to hold the housing fastened together. Mutually facing hooks 3 are disposed on the rear side of the housing, one of which hooks is spring-loaded. These hooks serve as means for mounting the housing on rails or other equivalent superstructure.

The lower screw clamp **4*b* is positioned toward the forward part of the switch 13, so that the lower section of the impact-armature tripping element 10 contains a free space 26 the exterior side of which is free of component parts of the automatic switch. A screw clamp 4*a* is disposed on an upper transverse face, and another screw clamp 4*b* is disposed on a lower transverse face; conductors for supplying and conducting away primary current can be connected to said screw clamps, or terminals. The upper screw clamp 4*a* is mounted on a support element 4 which extends into the housing and bears a bimetallic tripping element 5 which is typically used for thermal cut-off functions. Tripping element 5 is connected to a switch lever 7 via a stranded metal wire 6. Switch lever 7 serves as a movable contact element which cooperates with a fixed contact element 9. Fixed contact element 9 is connected to a coil 23 of an impact-armature tripping element, or solenoid 10, which contains a two-piece spring-loaded rod 21 and 24. The other end of the coil 23 is connected to the lower screw clamp (terminal) 4*b* via a stranded metal wire 11**.

The switch lever 7 is mounted so as to pivot about an axis peg 12. The arm of lever 7, which is directed toward the front side 13 of the switch, has rotatably mounted on it a three-armed arresting lever 14. The bimetallic tripping element 5 acts on one arm **14*a* of the arresting lever 14, via an adjustable set screw 5*a*. The rod 21 of the impact-armature tripping element 10 acts on the second arm 14*b* of the lever 14. The third arm 14*c* of the arresting lever 14 cooperates with a detent lever 15 which is pivotally mounted on a peg or rivet 16 on the forward end of the switch lever 7. One end of a link piece 17 is also pivotally mounted on the detent lever 15 but on a different axis as shown. The other end of link piece 17 is pivotally connected to a hand lever 18 which itself is pivotally mounted such that the grip member 18*a* extends through an opening in the forward sidewall 13. Hand lever 18 is spring-loaded by a flat wire spring 19 which tends to bring the grip member 18*a* to its uppermost position which corresponds to the "open" state of the switch. Further, switch lever arm 7 is secured by a tension spring 20**.

A set of deionization plates 22, of generally known composition, is disposed inside a single arcing chamber 8 along with the contact elements 7 and 9, the latter of which serves as an arrestor terminal.

The impact-armature tripping element (solenoid) 10 is disposed near the deionization plates 22; it is comprised of the projecting armature rod 21, coil 23, and a second armature core 24 which is spring-loaded with a spring 25. When a sharply increased current flows through the automatic switch, and thereby through the coil 23, the armature core 24 is accelerated against the force of the spring 25, whereby said core 24 acts on the arresting lever arm **14*b* via the intermediary armature rod 21**.

An additional circuit-breaking device 27 adjoins the free zone 26 at the lower transverse side of the automatic switch. Device 27 has two terminals 28 for a current or voltage signal from from the above-mentioned event which signal is introduced to bring about breaking of the switch contacts 7 and 9. The additional circuit-breaking device 27 is comprised of an actuating device 29 facing the sidewall zone 26 and coupling rod 30 which extends outward from the device 29 and passes through the wall of device 27 and the wall of zone 26.

Figure 2:
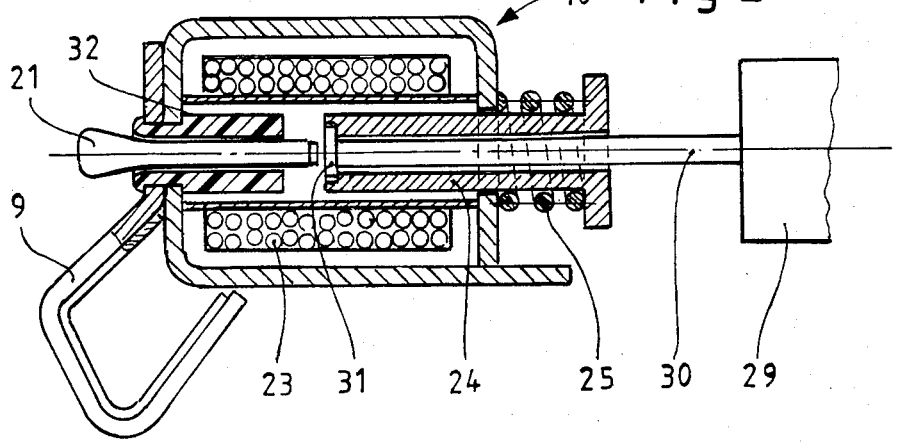
FIG. 2 is a magnified cross-sectional view of a detail of FIG. 1 showing the dual-plunger solenoid.

According to FIG. 2, the coupling rod 30 also extends through a borehole in the armature core 24, whereby its extreme end, cooperating with disk 31 may act on the armature rod 21 on which hollow armature core 24 also acts to break contact between elements 7 and 9. The armature rod 21 is supported in a fixed bushing 32 and is comprised of plastic material. The disk 31 is countersunk in a recess in the face of the armature core 24.

I claim:

1. In an automatic switch including a narrow housing having a side wall, a movable contact element movable by a switch mechanism into contact with a fixed contact element to a closed position to be held in the closed position under force, and an impact-armature tripping means to release the closing force and open the switch contact elements having a coil, an impact armature core in the coil, an armature rod projecting forwardly toward the contacts, and a back side opposite to the side of the projecting rod disposed near and parallel to a region of the side wall, the improvement comprising:

the exterior of the side wall region parallel to the back side of the impact-armature tripping means is free of component parts of the automatic switch;

an axial bore hole in said armature core; and an additional circuit-breaking device comprising, an operating device, a coupling rod operatively supported by said operating device to be activated thereby and projecting therefrom through said side wall region and into said axial bore hole in reciprocal sliding relationship therewith;

so that actuation of said coupling rod by said operating device moves said coupling rod through said axial bore hole to move the armature rod to open the switch contact elements.

2. An automatic switch as claimed in claim 1 wherein, the diameter of said axial bore hole is less than one-half the diameter of the armature core.

3. An automatic switch as claimed in claim 1 wherein, said coupling rod is comprised of a non-ferromagnetic material.

4. An automatic switch as claimed in claim 2 wherein, said coupling rod is comprised of a non-ferromagnetic material.

5. An automatic switch as claimed in claim 3 wherein, said non-ferromagnetic material is plastic.

6. An automatic switch as claimed in claim 1 wherein, said coupling rod is a distinct part from said armature rod.

7. An automatic switch as claimed in claim 2 wherein, said coupling rod is a distinct part from said armature rod.

8. An automatic switch as claimed in claim 3 wherein, said coupling rod is a distinct part from said armature rod.

9. An automatic switch as claimed in claim 6 and further comprising:

a counterbore in the end of the armature core adjacent the armature rod;

a disc member at the end of said coupling rod adjacent said end of the armature core disposed in said counterbore so that it is countersunk in said end of the armature core and engages the armature rod upon said actuation of said coupling rod.

10. An automatic switch as claimed in claim 7 and further comprising:

a counterbore in the end of the armature core adjacent the armature rod;

a disc member at the end of said coupling rod adjacent said end of the armature core disposed in said counterbore so that it is countersunk in said end of the armature core and engages the armature rod upon said actuation of said coupling rod.

11. An automatic switch as claimed in claim 8 and further comprising:

a counterbore in the end of the armature core adjacent the armature rod;

a disc member at the end of said coupling rod adjacent said end of the armature core disposed in said counterbore so that it is countersunk in said end of the armature core and engages the armature rod upon said actuation of said coupling rod.

* * * * *